US012310438B2

(12) United States Patent
Choi

(10) Patent No.: US 12,310,438 B2
(45) Date of Patent: May 27, 2025

(54) WORK GLOVE AND A MULTI-LAYERED FERROMAGNETIC POUCH FOR USE WITH A WORK GLOVE

(71) Applicant: Wai Nam Lawrence Choi, Fo Tan (HK)

(72) Inventor: Wai Nam Lawrence Choi, Fo Tan (HK)

( * ) Notice: Subject to any disclaimer, the term of this patent is extended or adjusted under 35 U.S.C. 154(b) by 233 days.

(21) Appl. No.: 17/626,066

(22) PCT Filed: Mar. 19, 2021

(86) PCT No.: PCT/CN2021/081809
§ 371 (c)(1),
(2) Date: Jan. 10, 2022

(87) PCT Pub. No.: WO2021/185355
PCT Pub. Date: Sep. 23, 2021

(65) Prior Publication Data

US 2022/0248786 A1 Aug. 11, 2022

(30) Foreign Application Priority Data

Mar. 20, 2020 (GB) ..... 2004125

(51) Int. Cl.
*A41D 19/015* (2006.01)
*A41D 19/00* (2006.01)
*A63B 71/14* (2006.01)

(52) U.S. Cl.
CPC ... *A41D 19/01594* (2013.01); *A41D 19/0037* (2013.01); *A41D 19/002* (2013.01);
(Continued)

(58) Field of Classification Search
CPC ..... A41D 19/002; A41D 19/01594; A41D 19/0037; A41D 19/015; A41D 19/01547; A41D 19/0024; A63B 71/141
(Continued)

(56) References Cited

U.S. PATENT DOCUMENTS 3,636,568 A 1/1972 Stuner
4,244,057 A * 1/1981 Burnham ..... A41D 19/0037 2/160
(Continued)

FOREIGN PATENT DOCUMENTS

CN 201468262 U 5/2010
CN 106307721 A * 1/2017
(Continued)

OTHER PUBLICATIONS

English Translation of CN-106307721-A (Year: 2017).*

*Primary Examiner* — Khaled Annis
*Assistant Examiner* — Dakota Marin
(74) *Attorney, Agent, or Firm* — Young Basile Hanlon & MacFarlane, P.C.

(57) ABSTRACT

A work glove (1,100,1000) for magnetically attracting and retaining one or more work items, the work glove (1,100, 1000) comprising: a glove body configured to receive a wearer's hand in use, the glove body having a back surface (2,200,2000) arranged to overlie the back of the wearer's hand; and a multi-layered pouch (4,400,4000) attached to the back surface (2,200,2000) of the glove body, wherein the multi-layered pouch (4,400,4000) comprises: a magnetic layer (6,600,6000) composed of a magnetic material; a covering layer (5,500,5000) arranged to contact the one or more work items; and a plurality of magnets (8,800,8000) or ferromagnetic bodies located between the magnetic layer (6,600,6000) and the covering layer (5,500,5000), each of the magnets (8,800,8000) or ferromagnetic bodies being
(Continued)

magnetically attached to the magnetic layer (6,600,6000) or ferromagnetic bodies layer, wherein the magnets (8,800, 8000) are arranged in spaced relationship.

24 Claims, 4 Drawing Sheets

(52) U.S. Cl.
CPC ..... *A41D 19/0024* (2013.01); *A41D 19/015* (2013.01); *A41D 19/01547* (2013.01); *A63B 71/141* (2013.01)

(58) Field of Classification Search
USPC ..... 2/161.6
See application file for complete search history.

(56) References Cited

U.S. PATENT DOCUMENTS 5,003,637 A * 4/1991 Lonon ..... A41D 19/0024 2/160
5,187,814 A * 2/1993 Gold ..... A41B 11/00 2/160
5,593,073 A * 1/1997 Finnegan ..... A44C 5/0007 224/267
5,706,521 A * 1/1998 Haney ..... A41D 19/0024 2/160
5,820,526 A * 10/1998 Hoffman ..... A63B 21/065 482/55
5,996,116 A * 12/1999 Tate ..... A63B 57/207 2/200.1
6,119,271 A 9/2000 Byon
6,170,088 B1 * 1/2001 Tate ..... A63B 57/35 2/200.1
6,393,614 B1 * 5/2002 Eichelbaum ..... A41D 19/002 2/160
6,643,845 B2 * 11/2003 O'Dea ..... A41D 19/01594 224/183
6,779,199 B1 * 8/2004 O'Dea ..... A41D 19/01594 224/183
7,146,651 B1 * 12/2006 Lapin ..... A41D 19/01594 2/338
8,060,948 B2 * 11/2011 Pesic ..... A45F 5/00 2/163
8,863,316 B2 * 10/2014 Gaskins ..... A63B 71/141 2/161.1
9,446,621 B1 * 9/2016 Verret ..... B43L 21/04
9,763,510 B1 * 9/2017 Miner ..... A45F 5/02
10,285,462 B2 * 5/2019 Charles ..... A63B 71/141
11,684,099 B2 * 6/2023 Shaikh ..... A41D 19/01535 2/160
2002/0148031 A1 * 10/2002 O'Dea ..... A41D 19/01594 2/160
2003/0122357 A1 * 7/2003 Rhue ..... B60R 11/06 280/770
2004/0031120 A1 * 2/2004 Cherian ..... A42B 3/26 15/210.1
2004/0173484 A1 9/2004 Bates et al.
2005/0210562 A1 * 9/2005 Johnson ..... A41D 19/002 2/159
2007/0234466 A1 * 10/2007 Stengel ..... A41D 20/00 2/160
2010/0095426 A1 * 4/2010 Esten ..... A41D 19/01594 2/163
2010/0251457 A1 * 10/2010 Lattimer ..... A41D 19/002 2/160
2012/0011633 A1 * 1/2012 Van Hale ..... A41D 19/002 2/169
2013/0326789 A1 * 12/2013 Lehrman ..... A41D 19/0034 2/160
2017/0172234 A1 * 6/2017 Cox ..... F24V 30/00
2018/0042316 A1 * 2/2018 Wiseman ..... A63B 57/60
2018/0289086 A1 * 10/2018 Anderson ..... A41D 19/002
2020/0013314 A1 * 1/2020 Hare ..... G09B 23/30

FOREIGN PATENT DOCUMENTS

CN 108056517 A 5/2018
CN 207411555 U 5/2018
CN 209073607 U 7/2019
JP 2018003198 A 1/2018
TW M514986 U 1/2016

* cited by examiner

WORK GLOVE AND A MULTI-LAYERED FERROMAGNETIC POUCH FOR USE WITH A WORK GLOVE

CROSS-REFERENCE TO RELATED APPLICATION(S)

This application is a national stage 371 application of PCT/CN2021/081809, filed on Mar. 19, 2021, which claims priority to and the benefit of United Kingdom Application Patent Serial No. GB 2004125.7, filed Mar. 20, 2020, the entire disclosures of which are hereby incorporated by reference.

The present invention relates to a work glove and a multi-layered magnetic pouch for use with a work glove for magnetically attracting and retaining one or more work items. More particularly, but not exclusively the present invention relates to a work glove and a multi-layered magnetic pouch for use with the work glove for magnetically attracting and retaining one or more work items as an aid for construction workers or other manual workers. Work gloves in accordance with this invention may include gloves for engineers, handymen and workmen and also gardening gloves, bicycle gloves, sports gloves or fashion gloves.

Known work gloves incorporate a single magnet within a glove, for example at a region corresponding to the back of a wearer's hand. Such a glove functions by allowing a wearer to engage an article comprising a ferromagnetic compound, such as a bolt or screw, with the magnet, leaving the wearer free to perform a task with his free fingers. Often the magnet is relatively large so as to provide a large magnetic surface area. A disadvantage of using a single magnet is that the magnetic attractive force felt by work items held on the magnetic surface often results in the work items becoming magnetically attached to each other. It can therefore be difficult to separate one work item without moving or dislodging another work item. Often removal of one work item results in the inadvertent removal of another work item, which may be dropped following removal of the magnetic attractive force.

A known work glove is shown in FIG. 1. The work glove comprises a glove body and an adhesively wrapped layered structure attached to a back surface of the glove body. The adhesively wrapped layered structure comprises a first layer composed of foam, a second layer, and a plurality of magnets located therebetween. The first layer includes a plurality of circular apertures. A single cylindrical magnet is located in each of the apertures.

Incorporation of several discrete magnets within the work glove of FIG. 1 helps to address the above mentioned disadvantage associated with use of a single large magnet. However, the work glove of FIG. 1 has several disadvantages.

Firstly, the magnets are tightly enclosed within the apertures of the first layer. This arrangement reduces the magnetic attractive force felt by work items retained on the glove.

Secondly, enclosing each magnet within an aperture increases the manufacturing complexity and consequently the associated manufacturing costs. Furthermore, the magnets are placed within the apertures at predetermined locations. Therefore, to enable placement of the magnets or additional magnets at other locations it would be necessary to modify the manufacturing process to allow for apertures to be formed at other locations.

Thirdly, use of discretely placed magnets reduces the effective magnetic working area of the glove. This may result in a held work item becoming dislodged. For example, a screw placed upon a surface of the glove may have its head located above the magnet with the shank extending into a region of the glove where there is no magnet located beneath. Thus, only a small proportion of the screw may feel the magnetic attractive force of the magnet, which thereby increases the possibility of the screw becoming dislodged.

According to a first aspect of the present invention there is provided a work glove for magnetically attracting and retaining one or more work items, the work glove comprising:

- a glove body configured to receive a wearer's hand in use, the glove body having a back surface arranged to overlie the back of the wearer's hand; and
- a multi-layered pouch attached to the back surface of the glove body, wherein the multi-layered pouch comprises:

- a magnetic layer composed of a magnetic material;
- a covering layer arranged to contact the one or more work items; and
- a plurality of magnets or ferromagnetic bodies located between the magnetic layer and the covering layer, each of the magnets or ferromagnetic bodies being magnetically attached to the magnetic layer, wherein the magnets are arranged in spaced relationship.

The ferromagnetic bodies may comprise magnetic or non-magnetic pieces of iron, steel or other ferrous metal According to a second aspect of the present invention there is provided a multi-layered magnetic pouch for attaching to a back surface of a glove body of a work glove so that the work glove may magnetically attract and retain one or more work items, the multi-layered magnetic pouch comprising:

- a magnetic layer composed of a magnetic material;
- a covering layer arranged to contact the one or more work items;
- a plurality of magnets or ferromagnetic bodies located between the magnetic layer and the covering layer, each of the magnets being magnetically attached to the magnetic layer, wherein the magnets are arranged in spaced relationship; and
- an attachment means for releasably securing the magnetic pouch to the back surface of the glove body.

The work glove includes a plurality of magnets or ferromagnetic bodies magnetically attached to a magnetic layer. The magnets or ferromagnetic bodies are referred to in this specification as "magnets" for brevity. This arrangement enables the manufacturer to place the magnets at any convenient location on the magnetic layer. The magnetic layer may also mitigate or prevent displacement of the magnets towards each other during manufacture of the glove and in use of the finished product.

Furthermore, the magnetic layer also provides a magnetic attractive force. This magnetic force may be felt by work items held on the covering layer. The covering layer may have regions of strong magnetic force located directly above each of the discrete magnets and regions of weaker magnetic force, predominantly provided by the magnetic layer, between each of the magnets. This arrangement synergistically increases the magnetic surface area. This may allow for greater quantities of work items to be securely held on the covering layer, especially in the vicinity of each of the magnets.

A further advantage is that the contact surface has different intensities of magnetic force. This helps to prevent held work items becoming magnetically attached to each other or strongly magnetically bound to each other. For example, one screw may be held by one magnet and a further screw may be held by another magnet, so that the shanks of each of the screws extend into and contact each other in a region of relatively weaker magnetic force between each of the magnets. Here, the shanks of the two screws would be weakly magnetically bound, and removal of one screw would be less likely to result in displacement or removal of the other screw.

The word pouch is taken to mean a back, sack, pocket or container which is closed on all sides or alternatively having one or more completely or partially open sides. An advantage of having one or more open sides is that a user may gain access to the interior of the pouch to facilitate removal or insertion of the magnets. The pouch may have a mouth which may be opened and closed, for example, using studs, clips or a sliding clasp fastener The covering layer and the magnetic layer may cooperatively define a plurality separate enclosures for each of the magnets. The covering layer may be arranged to contact the magnetic layer at a series of locations and thereby define the separate enclosures, for example pockets.

Preferably, the enclosures are aligned parallel to each other. These arrangements may further prevent displacement of the magnets towards each other during manufacture of the glove and in use of the finished product.

The covering layer may be attached to the magnetic layer at said series of locations. The covering layer may be adhesively attached to the magnetic layer at said series of locations. Alternatively, the covering layer may be stitched or secured by fasteners or clips to the magnetic layer at said series of locations.

Alternatively, the covering layer may comprise a plurality of separate enclosures for each of the magnets. The separate enclosures may be formed by stitching or application of adhesive to the adjacent layers. The enclosures may be open at one end to allow the magnets to be removed from the enclosures. Alternatively, the enclosures may be formed as sealed enclosures.

The covering layer may be hingedly attached to a side of the magnetic layer to form a flap, for example by means of stitching. The arrangement may form a wallet which may be used to retain items. This arrangement allows a user to hold non-metallic items, such as plastic strap fasteners and cable ties, between the covering layer and the magnetic layer when the covering layer and magnetic layer are magnetically engaged to each other.

The work glove may further comprise at least one additional magnet stacked onto all or some of the magnets arranged in a spaced apart relationship. The stacked magnets are preferably magnetically attached to each other. Stacking a group of magnets increases the magnetic force exerted in the region above the stacked magnets on the covering surface.

The magnetic layer may be a magnetic rubber layer. The magnetic material of the magnetic layer may be selected from a group consisting of ferrite, iron or steel particles or particles of other ferromagnetic material.

The magnetic layer may be a flexible laminar undivided layer or sheet of magnetic material.

The magnetic layer may be a flexible polymeric or elastomeric layer or sheet, including a filler of magnetic particulate material.

The multi-layered pouch and the back surface of the glove body may be reversibly or releasably attached to each other.

The multi-layered pouch and the back surface of the glove body may be reversibly or releasably attached by an attachment means. Preferably the attachment means is an attachment layer as described below.

Preferably, the multi-layered pouch further comprises an attachment layer located on the magnetic layer, the attachment layer being configured to be reversibly or releasably attached to the back surface of the glove body. The attachment layer and the back surface of the glove body may be reversibly or releasably attached to each other with hook and pile fasteners, for example Velcro tapes. Alternatively, the attachment layer and the back surface of the glove body may be reversibly or releasably attached to each other with press-button or snap fasteners.

Releasable attachment of the multi-layered pouch simplifies manufacture of the work glove and also allows the user to use the glove as a normal glove, i.e. with the multi-layered pouch removed, in the event that the user does not want to inadvertently pick up work items on the glove.

A further advantage is that gloves in accordance with this invention may be stored by attachment to a ferromagnetic surface.

The gloves may be personalised by decoration with, for example, a distinctive pattern or text which may be applied by various means, including printing or embroidery.

According to a third aspect of the present invention there is provided a kit of parts comprising:

- a work glove comprising a glove body configured to receive a wearer's hand in use, the glove body having a back surface arranged to overlie the back of the wearer's hand; and
- a multi-layered magnetic pouch as disclosed above.

The invention is further described by means of example, but not in any limitative sense with reference to the accompanying drawings, in which:

FIG. 1 shows a known work glove used to magnetically secure one or more work items onto the back of the glove.

Figure 1:
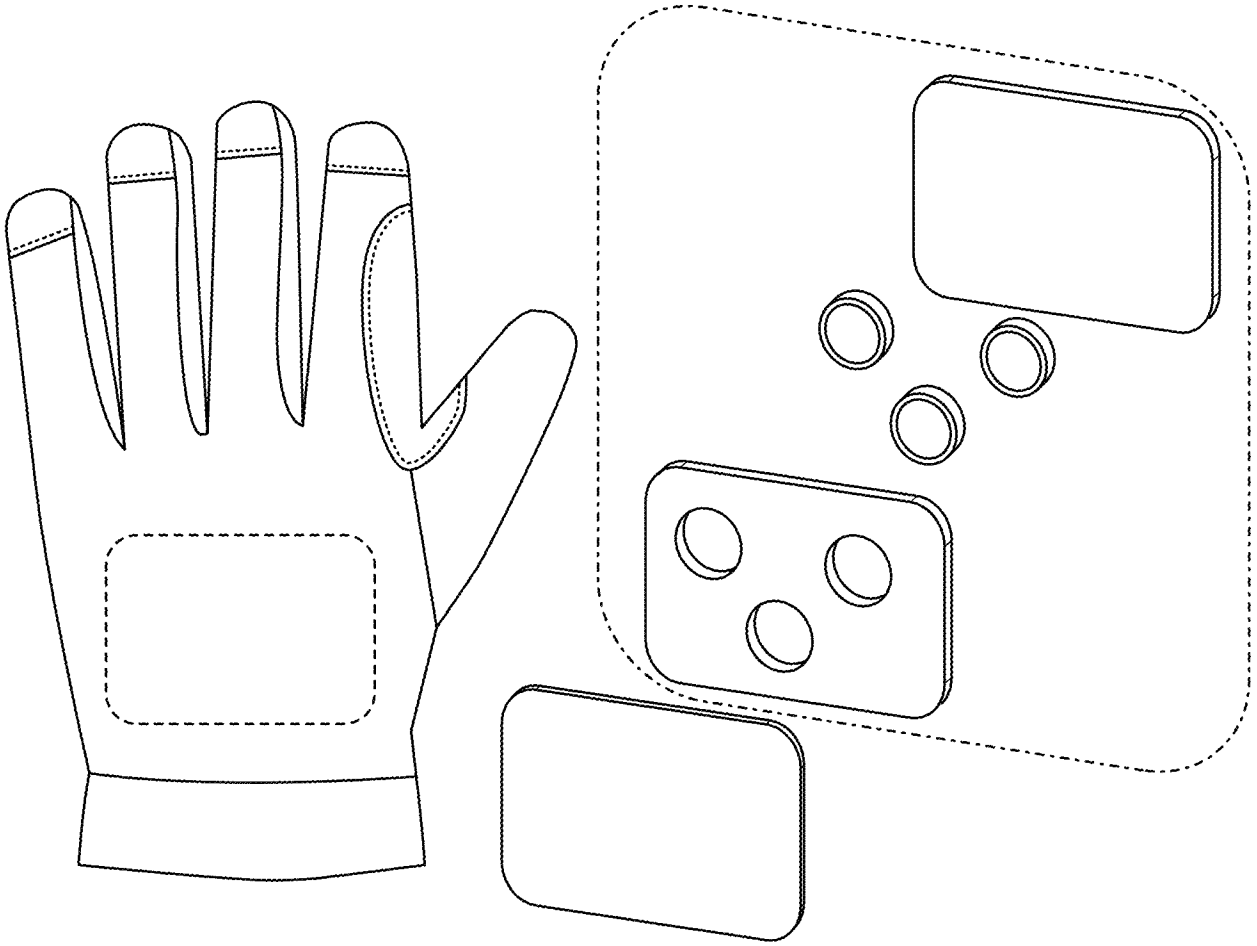
FIG. 1 is an exploded perspective view of a known work glove.
Figure 2:
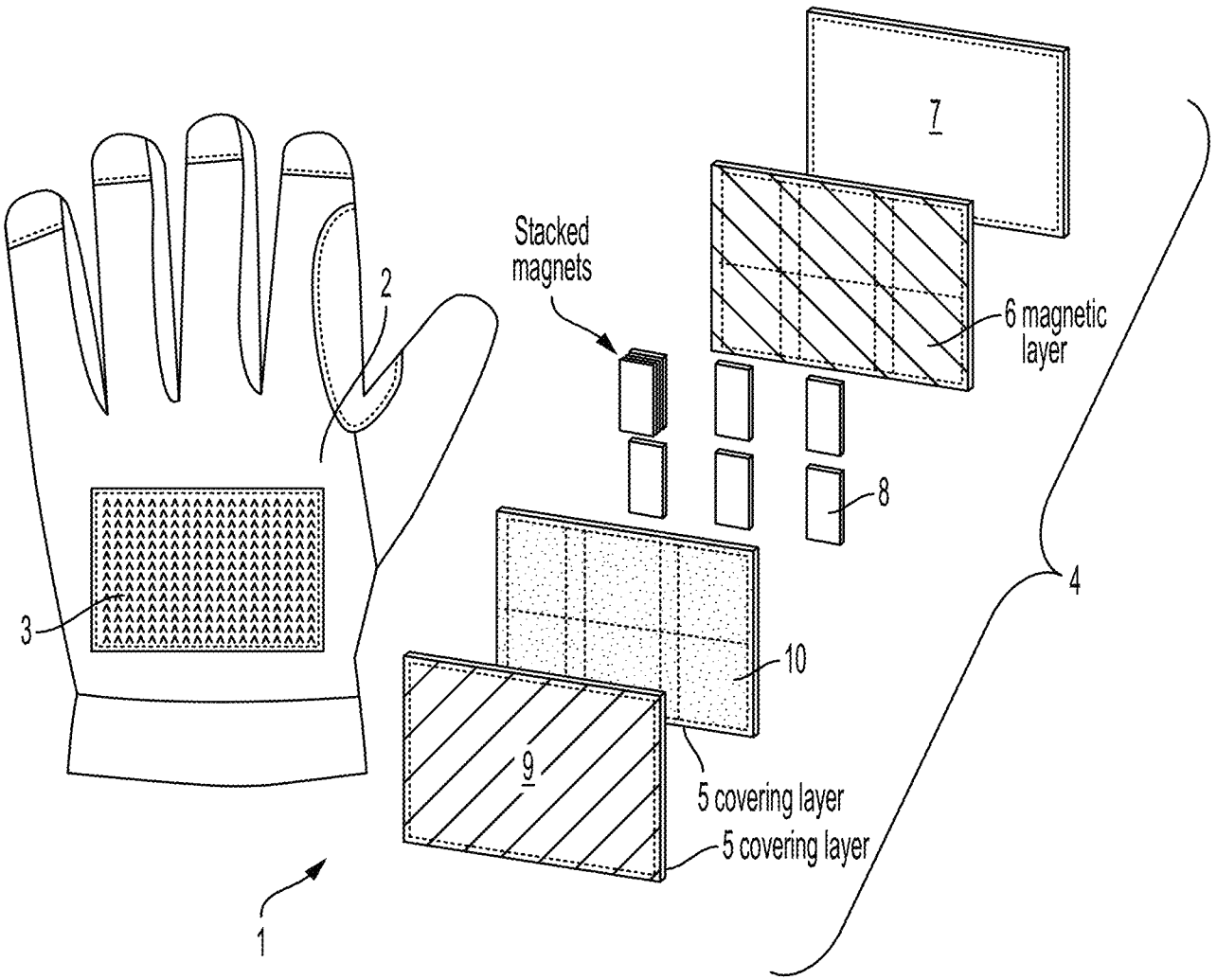
FIG. 2 is an exploded perspective view of the work glove according to the invention.

FIG. 2 shows work glove 1 comprising a glove body. The glove body may be constructed from a variety of materials, including, but not limited to leather, vinyl, woven or knitted fabrics for example of artificial fibres, cotton, cotton/polyester blends and rubber. The glove body has a back surface 2. The back surface 2 includes a rectangular patch 3 with hook fasteners. Any conveniently shaped patch may be used. The patch 3 may be attached to the back of the glove 1 with adhesive, stitching, or any other suitable attachment means.

The work glove 1 further comprises a rectangular multi-layered pouch 4 which is shown in an exploded view. Any shaped pouch may be used. The pouch 4 comprises a covering layer 5, a magnetic layer 6 composed of a magnetic material, an attachment layer 7, and a plurality of magnets 8. The pouch 4 functions to attract and maintain work items, such as nails, bolts, nuts and screws against the back surface 2 of the work glove 1.

The covering layer 5 includes an outer layer 9 and optionally an inner mesh or net layer 10. The outer 9 and inner 10 layers may be constructed from a variety of material, including, but not limited to leather, vinyl, woven or knitted fabrics for example of artificial fibres, cotton, cotton/polyester blends and rubber.

The plurality of magnets 8 are magnetically attached to the magnetic layer 6 in spaced apart relationship to minimise magnetic attraction or repulsion between adjacent magnets. The magnets may be arranged in an array, for example in a series of rows and columns. The magnets are preferably arranged in a symmetrical pattern. Alternatively, the magnets may be arranged asymmetrically. The covering layer 5 is arranged over the magnets and attached to a first side of the magnetic layer 6.

The attachment layer 7 includes pile fasteners for attachment to the hook fasteners of the patch 3 of the glove body. The attachment layer 7 is attached to a second side of the magnetic layer 6.

The layers of the pouch 4 may be attached to each other with adhesive, stitching, or any other suitable attachment means. Preferably, the layers are attached around an outer perimeter of the pouch 4. The pouch 4 may be sealed to prevent access to the interior of the pouch space. Alternatively, the pouch may have one or more peripheral portions capable of being opened for accessing the interior pouch space to, for example, allow a user to reposition or remove the magnets 8, or to add additional magnets.

The covering layer 5 and the magnetic layer 6 may cooperatively define separate enclosures for each of the magnets. For example, the inner mesh or net layer 10 may be attached to the magnetic layer 6 at a series of locations to thereby define the separate enclosures. The netting or mesh forming part of the enclosure may help to prevent the magnets 8 from being displaced across the surface of the magnetic layer 6 and thereby contacting each other. The inner mesh or net layer 10 may be attached to the magnetic layer 6 with adhesive, stitching, or any other suitable attachment means.

Figure 3:
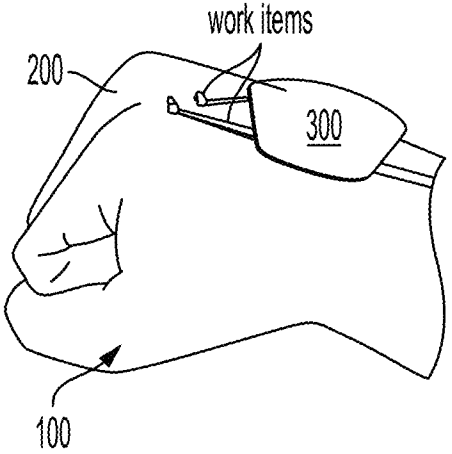
FIG. 3 is an exploded perspective view of an alternative embodiment of the work glove according to the invention.
Figure 3:
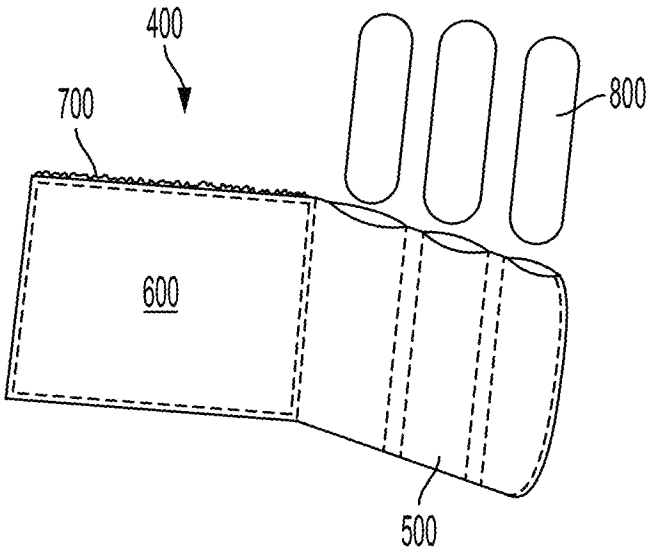

FIG. 3 shows an alternative embodiment of a work glove 100 according to the invention. The work glove 100 comprises a glove body. The glove body may be constructed from a variety of materials, including, but not limited to leather, vinyl, woven or knitted fabrics for example of artificial fibres, cotton, cotton/polyester blends and rubber. The glove body has a back surface 200. The back surface 200 includes a rectangular patch 300 with hook fasteners. Any conveniently shaped patch may be used. The patch 300 may be attached to the back of the glove 100 with adhesive, stitching, clips or any other suitable attachment means.

The work glove 100 further comprises a rectangular multi-layered pouch 400 which is shown in an exploded view. Any shaped pouch may be used. The pouch 400 comprises a covering layer 500, a magnetic layer 600 composed of a magnetic material, an attachment layer 700, and a plurality of magnets 800. The pouch 400 functions to attract and maintain work items, such as nails, bolts, nuts and screws against the back surface 200 of the work glove 100.

The covering layer 500 includes a plurality of separate enclosures formed within the covering layer 500 and defined by stitching. Each of the enclosures are dimensioned to receive a magnet 800. The enclosures may be open at one end to allow the magnets 800 to be removed from the enclosures. Alternatively, the enclosures may be formed as sealed enclosures. The covering layer 500 may be constructed from a variety of material, including, but not limited to leather, vinyl, woven or knitted fabrics for example of artificial fibres, cotton, cotton/polyester blends and rubber.

The covering layer 500 is hingedly attached to a side of the magnetic layer 600 to form a flap, for example via stitching. The covering layer 500 is foldable about the hinge from an engaged position where the covering layer 500 contacts and covers a first side of the magnetic layer 600, to a disengaged position where the covering layer 500 does not contact the first side of the magnetic layer 600.

The plurality of magnets 800 are magnetically attached to the magnetic layer 600 when the covering layer 500 is in the engaged position. The magnets 800 are in spaced apart relationship to minimise magnetic attraction or repulsion between adjacent magnets. The magnets may be arranged in an array, for example in a series of rows and columns.

The magnets 800 are preferably arranged in a symmetrical pattern. Alternatively, the magnets 800 may be arranged asymmetrically. This arrangement allows a user to hold non-metallic items, such as plastic strap fasteners and cable ties, between the covering layer and the magnetic layer when the covering layer and magnetic layer are magnetically engaged to each other.

The attachment layer 700 includes pile fasteners for attachment to the hook fasteners of the patch 300 of the glove body. The attachment layer 700 is attached to a second side of the magnetic layer 600.

The covering layer 500 may be elongated, having a first fixed portion extending across the surface of the magnetic layer 600 and having a second moveable portion, hingedly connected along an edge of the fixed portion and moveable between an open position in which a non-ferromagnetic material such as a cable-tie may be received between the fixed and moveable portions; and a closed position in which the moveable portion overlies the fixed portion and is secured thereto by magnetic attraction between the magnetic layer 600 and magnets 800, so that the non-ferromagnetic article is securely held in the fixed and moveable portions.

Figure 4:
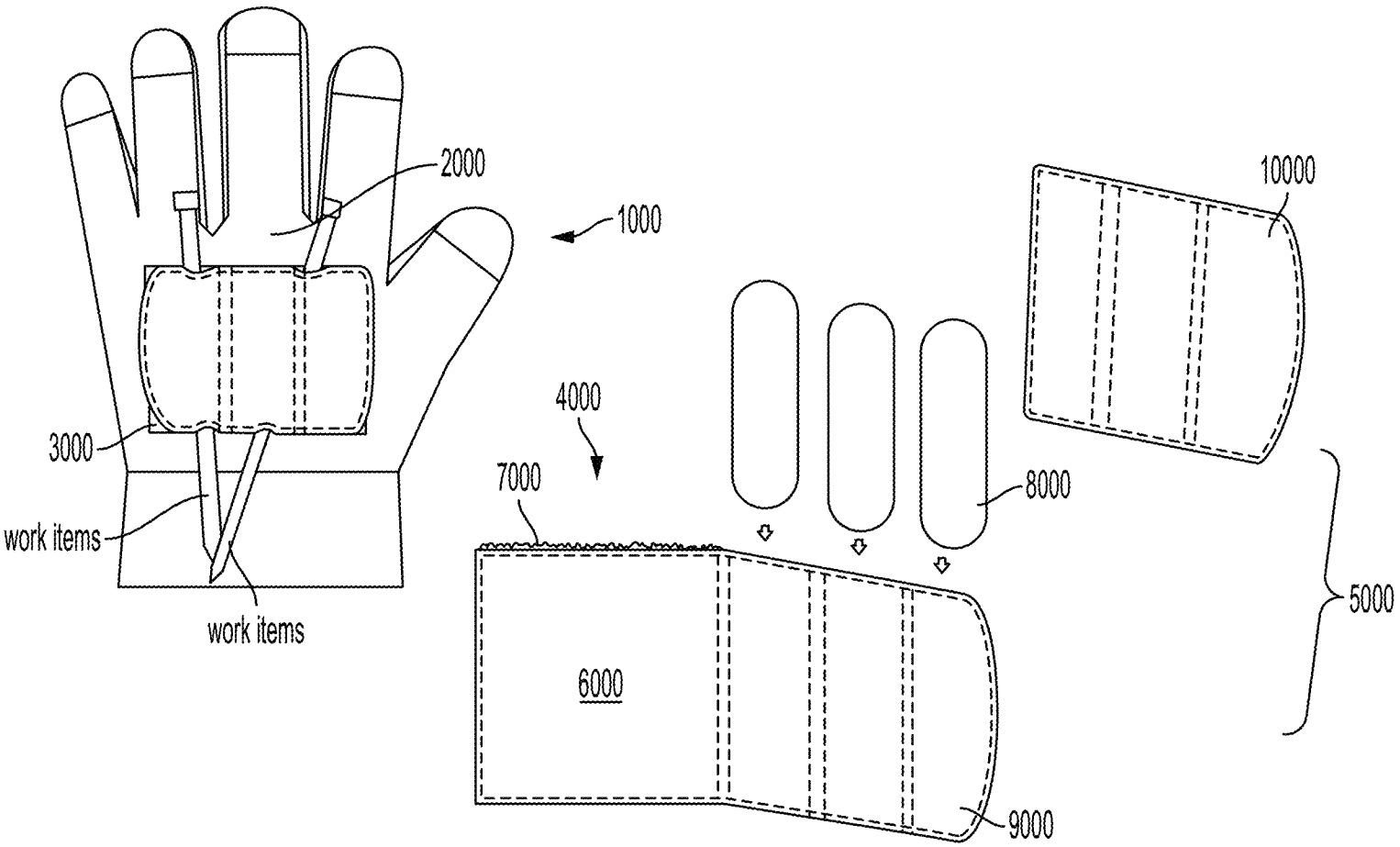
FIG. 4 is an exploded perspective view of a further alternative embodiment of the work glove according to the invention.

FIG. 4 shows an alternative embodiment of a work glove 1000 according to the invention. The work glove 1000 comprises a glove body. The glove body may be constructed from a variety of materials, including, but not limited to leather, vinyl, woven or knitted fabrics for example of artificial fibres, cotton, cotton/polyester blends and rubber. The glove body has a back surface 2000. The back surface 2000 includes a rectangular patch 3000 with hook fasteners. Any conveniently shaped patch may be used. The patch 3000 may be attached to the back of the glove 1000 with adhesive, stitching, or any other suitable attachment means.

The work glove 100 further comprises a rectangular multi-layered pouch 4000 which is shown in an exploded view. Any shaped pouch may be used. The pouch 4000 comprises a covering layer 5000, a magnetic layer 6000 composed of a magnetic material, an attachment layer 7000, and a plurality of magnets 8000. The pouch 4000 functions to attract and maintain work items, such as nails, bolts, nuts and screws against the back surface 2000 of the work glove 1000.

The covering layer 5000 includes an outer layer 9000 and an inner layer 10000. The inner layer 10000 may be formed from meshing or netting. The outer 9000 and inner 10000 layers may be constructed from a variety of material, including, but not limited to leather, vinyl, woven or knitted fabrics for example of artificial fibres, cotton, cotton/polyester blends and rubber.

The covering layer 5000 is hingedly attached to a side of the magnetic layer 6000 to form a flap, for example using stitching. The covering layer 5000 is foldable about the hinge from an engaged position where the inner layer 10000 of the covering layer 5000 contacts and covers a first side of the magnetic layer 6000, to a disengaged position where the covering layer 5000 does not contact the first side of the magnetic layer 6000.

The plurality of magnets 8000 are magnetically attached to the magnetic layer 6000 when the covering layer 5000 is in the engaged position. The magnets 8000 are in spaced apart relationship to minimise magnetic attraction or repulsion between adjacent magnets. The magnets may be arranged in an array, for example in a series of rows and columns. The magnets are preferably arranged in a symmetrical pattern. Alternatively, the magnets may be arranged asymmetrically. This arrangement allows a user to hold non-metallic items, such as plastic strap fasteners and cable ties, between the covering layer and the magnetic layer when the covering layer and magnetic layer are magnetically engaged to each other.

The attachment layer 7000 includes pile fasteners for attachment to the hook fasteners of the patch 3000 of the glove body. The attachment layer 7000 is attached to a second side of the magnetic layer 6000.

The outer 9000 and inner 10000 layers of the pouch 4000 may be attached to each other with adhesive, stitching, or any other suitable attachment means. Preferably, the layers are attached around an outer perimeter of the pouch 4000. The pouch 4000 may be sealed to prevent access to the interior of the pouch space. Alternatively, the pouch may have one or more peripheral portions capable of being opened for accessing the interior pouch space, for example, to allow a user to reposition or remove the magnets 8000, or to add additional magnets.

The outer 9000 and inner 10000 layers of the pouch 4000 cooperatively define separate enclosures for each of the magnets. For example, the inner layer 10000 may be attached to the outer layer 9000 at a series of locations to thereby define the separate enclosures. This arrangement helps to prevent the magnets 8000 from being displaced across the surface of the magnetic layer 6000 and thereby contacting each other. The inner layer 10000 may be attached to the outer layer 9000 with adhesive, stitching, or any other suitable attachment means.

The present invention is illustrated in FIGS. 2 and 4 with respect to a left-handed glove and in FIG. 3 with respect to a right-handed glove merely for convenience. It is to be understood that the present invention is equally applicable to both left and right handed gloves.

Various modifications will be apparent to those skilled in the art. In an embodiment the pouch 4 may be permanently attached to the back surface 2 of the work glove 1. For example, the magnetic layer 6 may be attached to the back surface 2 with adhesive, stitching, or any other suitable attachment means. Alternatively, the pouch 4 may be attached internally on the underside of the back surface 2 of the work glove 1.

The invention claimed is:

1. A work glove for magnetically attracting and retaining one or more work items, the work glove comprising:

a glove body configured to receive a wearer's hand in use, the glove body having a back surface arranged to overlie the back of the wearer's hand; and a multi-layered pouch attached to the back surface of the glove body, wherein the multi-layered pouch comprises:

a magnetic layer composed of a flexible undivided layer of magnetic material;

a covering layer arranged to contact the one or more work items;

wherein the covering layer further comprises an inner layer and an outer layer; and a plurality of magnets or ferromagnetic bodies located between the magnetic layer and the covering layer, each of the magnets or ferromagnetic bodies being magnetically attached to the magnetic layer, wherein the magnets are arranged in spaced relationship.

2. The work glove as claimed in claim 1, wherein the covering layer and the magnetic layer cooperatively define a plurality of separate enclosures for each of the magnets or ferromagnetic bodies.

3. The work glove as claimed in claim 2, wherein the covering layer is arranged to contact the magnetic layer at a series of locations and thereby define the separate enclosures.

4. The work glove as claimed in claim 3, wherein the covering layer is attached to the magnetic layer at said series of locations.

5. The work glove as claimed in claim 1, wherein the covering layer comprises a plurality of separate enclosures for each of the magnets.

6. The work glove as claimed in claim 2, further comprising at least one additional magnet stacked onto each of the magnets in spaced apart relationship.

7. The work glove as claimed in claim 1, wherein the multi-layered pouch and the back surface of the glove body are releasably attached to each other.

8. The work glove as claimed in claim 7, wherein the multi-layered pouch further comprises an attachment layer located on the magnetic layer, the attachment layer being configured to be releasably attached to the back surface of the glove body.

9. The work glove as claimed in claim 8, wherein the attachment layer and the back surface of the glove body are releasably attached to each other with hook and pile fasteners.

10. The work glove as claimed in claim 1, wherein the covering layer is hingedly attached to a side of the magnetic layer.

11. The work glove as claimed in claim 10, wherein the covering layer has a first fixed portion extending across a surface of the magnetic layer and having a second moveable portion hingedly connected along an edge of the fixed portion and moveable between an open position in which a work item is received between the fixed and moveable portions, and a closed position in which the moveable portion overlies the fixed portion and is secured thereto by magnetic attraction between the magnetic layer and magnets, so that the article is secured between the fixed and moveable portions.

12. The work glove claimed as in claim 1, where the magnetic layer is a magnetic rubber layer.

13. A multi-layered magnetic pouch for attaching to a back surface of a glove body of a work glove so that the work glove magnetically attracts and retains one or more work items, the multi-layered magnetic pouch comprising:

a magnetic layer composed of a flexible undivided layer of magnetic material;

a covering layer arranged to contact the one or more work items;

wherein the covering layer further comprises an inner layer and an outer layer;

a plurality of magnets or ferromagnetic bodies located between the magnetic layer and the covering layer, each of the magnets or ferromagnetic bodies being magnetically attached to the magnetic layer, wherein the magnets or ferromagnetic bodies are arranged in spaced relationship; and an attachment means for releasably securing the magnetic pouch to the back surface of the glove body.

14. The multi-layered magnetic pouch as claimed in claim 13, wherein the covering layer and the magnetic layer cooperatively define a plurality of separate enclosures for each of the magnets or ferromagnetic bodies.

15. The multi-layered magnetic pouch as claimed in claim 14, wherein the covering layer is arranged to contact the magnetic layer at a series of locations and thereby define the separate enclosures.

16. The multi-layered magnetic pouch as claimed in claim 15, wherein the covering layer is attached to the magnetic layer at said series of locations.

17. The multi-layered magnetic pouch as claimed in claim 13, wherein the covering layer comprises a plurality of separate enclosures for each of the magnets or ferromagnetic bodies.

18. The multi-layered magnetic pouch as claimed in claim 13, further comprising at least one additional magnet stacked onto each of the magnets or ferromagnetic bodies in spaced apart relationship.

19. The multi-layered magnetic pouch as claimed in claim 13, wherein the attachment means is an attachment layer located on the magnetic layer, the attachment layer being configured to be releasably attached to the back surface of the glove body.

20. The multi-layered magnetic pouch as claimed in claim 19, wherein the attachment layer and the back surface of the glove body are releasably attached to each other with hook and pile fasteners.

21. The multi-layered magnetic pouch as claimed in claim 13, wherein the covering layer is hingedly attached to a side of the magnetic layer.

22. The multi-layered magnetic pouch as claimed in claim 13, wherein the covering layer has a first fixed portion extending across a surface of the magnetic layer and having a second moveable portion hingedly connected along an edge of the fixed portion and moveable between an open position in which a work item is received between the fixed and moveable portions, and a closed position in which the moveable portion overlies the fixed portion and is secured thereto by magnetic attraction between the magnetic layer and magnets, so that the article is secured between the fixed and moveable portions.

23. The multi-layered magnetic pouch as claimed in claim 13, wherein the magnetic layer is a magnetic rubber layer.

24. A kit comprising:

a work glove comprising a glove body configured to receive a wearer's hand in use, the glove body having a back surface arranged to overlie the back of the wearer's hand; and a multi-layered magnetic pouch comprising:

a magnetic layer composed of a flexible undivided layer of magnetic material;

a covering layer arranged to contact the one or more work items;

wherein the covering layer further comprises an inner layer and an outer layer;

a plurality of magnets or ferromagnetic bodies located between the magnetic layer and the covering layer, each of the magnets or ferromagnetic bodies being magnetically attached to the magnetic layer, wherein the magnets or ferromagnetic bodies are arranged in spaced relationship; and an attachment means for releasably securing the magnetic pouch to the back surface of the glove body.

* * * * *